United States Patent [19]

Christen et al.

[11] Patent Number: 4,600,226

[45] Date of Patent: Jul. 15, 1986

[54] LOCK WITH ANCHOR MOUNT

[76] Inventors: Chris R. Christen, 64 Summitcrest Dr., Weston, Ontario, Canada, M9P 1H5; Frank M. Cianfarani, 2757 Battleford Dr., Apt. 15-32, Mississauga, Ontario, Canada, L5N 3A8

[21] Appl. No.: 661,497

[22] Filed: Oct. 16, 1984

[30] Foreign Application Priority Data

Oct. 4, 1984 [CA] Canada ..... 464787

[51] Int. Cl.[4] ..... E05C 17/36

[52] U.S. Cl. ..... 292/264; 411/84; 292/DIG. 53

[58] Field of Search ..... 411/84, 104, 174, 175; 292/264, 337, 346, 357, DIG. 53

[56] References Cited

U.S. PATENT DOCUMENTS

| | | | |
|---|---|---|---|
| 242,568 | 6/1881 | Sparks . | |
| 856,246 | 6/1907 | Gamon | 411/84 |
| 1,777,146 | 9/1930 | McGlaughlin . | |
| 1,824,045 | 9/1931 | Fetyk . | |
| 2,087,755 | 7/1937 | Dayton . | |
| 2,470,735 | 5/1949 | Young | 292/340 |
| 2,558,720 | 7/1951 | Hansman | 411/175 |
| 2,795,452 | 6/1957 | Schamel | 292/340 |
| 3,192,981 | 7/1965 | Oliver | 411/104 X |
| 3,667,794 | 6/1972 | Lentz, Jr. | 292/264 |
| 3,705,504 | 12/1972 | Johnson | 70/292 |
| 3,936,085 | 2/1976 | Long | 292/264 |
| 4,027,908 | 6/1977 | Crepinsek | 292/264 |
| 4,073,523 | 2/1978 | Long | 292/264 |
| 4,079,973 | 3/1978 | Hollins | 292/264 |
| 4,452,476 | 6/1984 | Stole | 292/264 |

*Primary Examiner*—Richard E. Moore

*Attorney, Agent, or Firm*—Schwarze, Jacobs & Nadel Panitch

[57] ABSTRACT

A chain-type lock suitable for a door having a locking chain with a locking bar connected to one end thereof and a chain holding member with the other end of the chain fastened thereto. A receiver for securing the locking bar in a locked position is also provided together with threaded fasteners for mounting the receiver and the holding member. Preferably an anchor device is provided for each of the receiver and the holding member in order to hold securely the threaded fasteners in the door, door jamb or the like. Each anchor is adapted for insertion to an opening formed in the door, door jamb or the like.

19 Claims, 8 Drawing Figures

LOCK WITH ANCHOR MOUNT

BACKGROUND OF THE INVENTION

This invention relates to locks and in particular locks suitable for securing a door, window or the like.

Chain-type locks are well known and have been used for many years to secure doors. The most common type of chain fastener has a short length of chain which is secured at one end to a door or door jamb by a suitable mounting plate. To the free end of the chain is fastened a locking bar which has an enlarged head. By inserting this head into a slot formed in another plate the lock can be secured. Both plates used in the standard chain-type lock are commonly fastened to the door or door jamb by means of ordinary screws. A common problem with such locks is that one of the plates can often be torn from the surface on which it is mounted by the application of sufficient force. Of course once one of the plates is torn loose, the door is free to open.

Early U.S. Pat. No. 242,568 issued June 7, 1881 to William Sparks describes a chain bolt having a small attachment plate to which the chain is attached and a larger plate having a hole therein which is almost circular except for two radially extending notches. A pendant lever is attached to the free end of the chain and it has a stud projecting from one side and having side projections thereon. When the stud is inserted into the opening in the larger plate, the lever will pivot under its own weight to lock the device.

U.S. Pat. No. 3,705,504 issued Dec. 12, 1972 to Dewey Johnson describes a chain door latch device adapted for use for inwardly and outwardly swinging doors having a latch bracket and a chain fastening member. The bracket is provided with an elongated slot with an enlarged opening at each end of the slot. The latch slide member which is fastened to the chain has mounted on its free end a matching enlarged member that is received by the enlarged openings in the bracket. The latch bracket is provided with a resilient member at the enlarged opening nearest the chain fastening member to prevent removal of the slide member therefrom.

U.S. Pat. No. 3,936,085 issued Feb. 3, 1976 to Donald Long describes a lock protector for wooden doors equipped with both the usual bolt or latch lock and a chain lock. There is provided a metal door plate of U-shape adapted to bridge the free edge portion of the door at the lock and apertured to pass the lock bolt. The chain is detachably connected to a chain plate which is strongly affixed to the door frame. The two metal plates provided are said to prevent the chain connections from being torn out by kicks or blows or pressure applied to the door. One problem with the described protector is that it is not designed to mount a chain lock on its own but is intended for use in conjunction with a standard bolt or latch lock.

It is an object of the present invention to provide a simple to use and inexpensive means for securely fastening a locking device to a door or door jamb. It is another object of the invention to provide a mechanism suitable for securely mounting a chain-type lock, the mounting plates for which are mounted on the inside surface of the door and door jamb.

SUMMARY OF THE INVENTION

According to one aspect of the present invention a locking device for a door, door jamb or the like is equipped with an anchor for securely fastening at least a portion of the device to the door, door jamb or the like. The anchor comprises a curved metal plate insertable into a hole formed in the edge or side of the door or door jamb. The plate has threaded openings formed therein, which openings are adapted to receive threaded fasteners extending through and from at least the aforementioned portion of the device. The anchor has an end plate with holes for additional fasteners provided therein. This end plate is rigidly fixed to one end of the curved metal plate.

According to another aspect of the invention a chain-type lock comprises a locking chain having a latch bar connected to one end thereof and a chain holder having the other end of the locking chain connected thereto and having holes therein for receiving threaded fasteners. A latch bar bracket can be used to secure the latch bar in a locked position and it has holes therein for receiving threaded fasteners as well. At least one anchor plate member having threaded holes therein for receiving the threaded ends of at least some of the threaded fasteners is provided. This plate member holds the fasteners securely in a door, door jamb or the like and it is adapted for insertion into an opening in the door, door jamb or the like. The anchor plate member has an end plate rigidly attached thereto at one end, which end plate provides means for positioning the anchor correctly in the opening.

In the preferred embodiment the anchor plate member is elongate and curved in a plane perpendicular to the longitudinal centreline of the plate member. There are two anchor plate members, one for each of the chain holder and the latch bar bracket.

Futher features and advantages will become apparent from the following detailed description of a preferred embodiment, given by way of example and taken in conjunction with the accompanying drawings.

DETAILED DESCRIPTION OF PREFERRED EMBODIMENT

Figure 1:
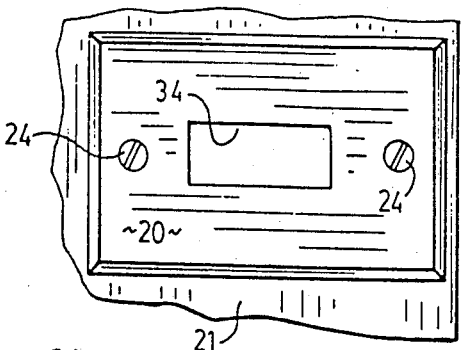
FIG. 1 is a front view showing a chain-type lock constructed in accordance with the present invention and fastened to a door and door jamb.
Figure 1:
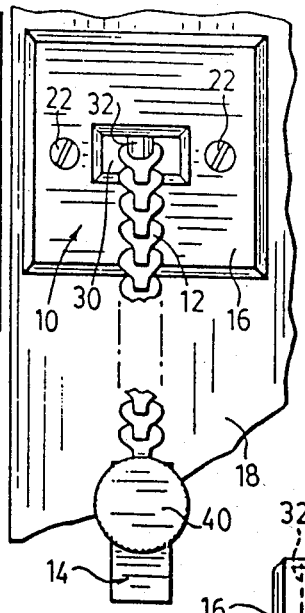
Figure 2:
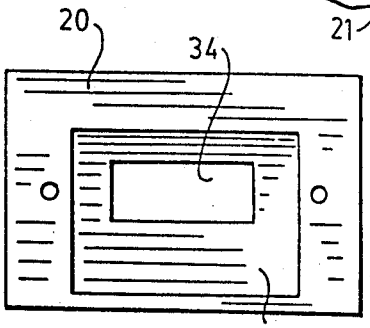
FIG. 2 is a rear view of the receiver used to secure the locking bar to a door or door jamb.
Figure 3:
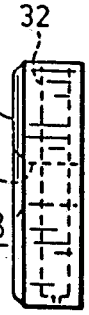
FIG. 3 is a side view of the chain holding member shown in FIG. 1.
Figure 4:
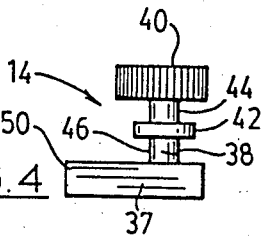
FIG. 4 is a side view of the locking bar or bolt attached to the free end of the chain.
Figure 5:
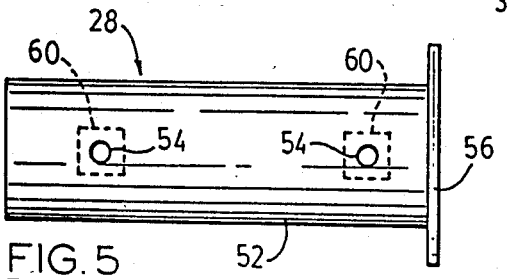
FIG. 5 is an elevational view of one anchor that can be used to secure either the chain holding member or the receiver.

A chain-type lock 10 constructed in accordance with the present invention has a locking chain 12 having a locking bar 14 connected to one end thereof. The lock includes a chain holding member 16 having an end of the locking chain fastened thereto. In the illustrated embodiment the holding member 16 is mounted on the inside surface of a door 18, only part of which is shown in FIG. 1. The lock also includes a receiver 20 for securing the locking bar in a locked position. In the illustrated embodiment the receiver is mounted on the inside surface of a door jamb 21. It will be appreciated that instead of the arrangement shown, the chain holding member 16 could be mounted on the door jamb while the receiver is mounted on the edge of the door 18.

Figure 7:
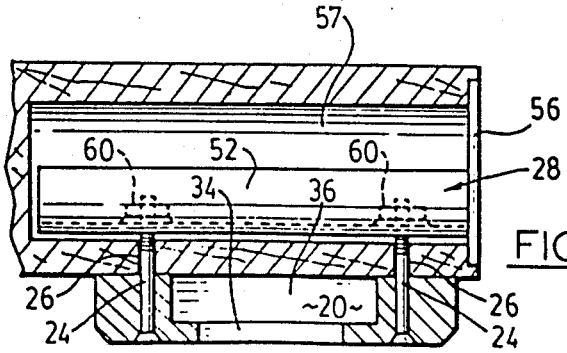
FIG. 7 is sectional plan view showing how the anchor can be used to secure the receiver shown in FIGS. 1 and 2.

First fastener means 22 in the form of bolts are used to mount the holding member 16 to the door. The bolts extend through holes formed in the holding member and in the door. Similarly second fastener means 24 are used to mount the receiver 20 to the door jamb and these fastener means can also be bolts that extend through holes in the receiver and in the door or door jamb. The bolts holding the receiver 20 are shown in FIG. 7 wherein there is also shown the drilled holes 26 in the door or door jamb through which the bolts extend. The inner ends of these bolts are threaded into nuts that are part of an anchor member 28 described further hereinafter.

Turning now to the preferred construction of the holding member 16, this member has an opening 30 provided in the centre thereof into which one end of the chain 12 extends. A hardened metal pin 32 is driven into a hole drilled through the width of the member and this pins extends across the opening 30 and through the end link of the chain. It will thus be seen that the chain is very securely held at one end by the member 16. If desired the pin 32 can be held in the member 16 by means of a force fit.

Turning now to the receiver 20, it also has an opening 34 formed in the front thereof and preferably located in the centre of the receiver. In the illustrated preferred embodiment, this opening is rectangular and is just large enough to permit passage of an elongate bar member 37 which is part of the locking bar 14. The receiver has a hollow space 36 in the back thereof large enough to permit the locking bar to pivot about the centre of its shaft 38 after the bar member 37 has passed through the opening 34. This pivoting motion causes the locking bar 14 to be locked in the receiver. It will be appreciated that the depth of the space 36 is at least as great and is preferably slightly greater than the thickness of the bar member 37.

The latch bar 14 is of simple construction and in addition to the aforementioned bar member 37 and shaft 38 includes a knurled knob 40 mounted on one end of the shaft 38. Midway along the shaft 38 is a spacer 42. It will be appreciated that the end link of the chain extends around the outer portion 44 of the shaft and the spacer 42 helps to keep this end link on the outer portion of the shaft. When the latch bar is in the locked position, the section 46 of the shaft extends through the opening 34 in the receiver. The knob 40 provides an easy means for turning the bar member 37 in order to remove it from the receiver and unlock the door. It should also be noted that the shaft 38 is mounted at the side of one end of the locking bar 37. In other words the shaft 38 is mounted off-centre to the length of the bar 37. In this way when the bar is inserted into the opening 34, the end 50 of the bar pivots downwards under its own weight. Thus removal of the bar member 37 is prevented unless someone on the inside grasps the knob 40 and turns it in order to align the bar member with the opening 34.

Figure 6:
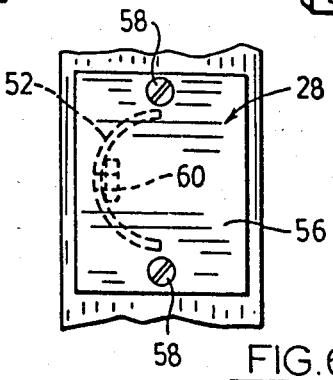
FIG. 6 is an end view showing the anchor of FIG. 5 mounted in the edge of a door.
Figure 8:
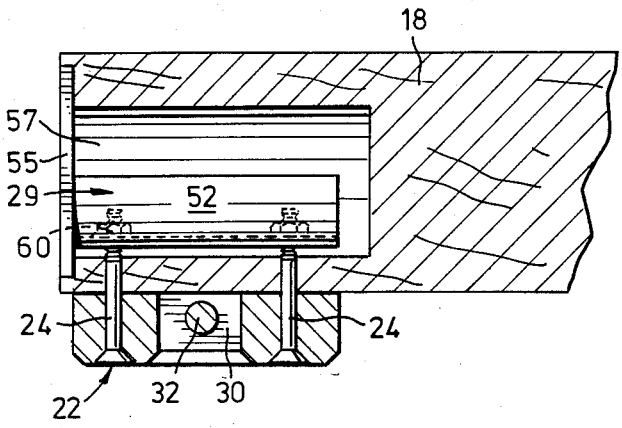
FIG. 8 is a sectional view, similar to FIG. 7, showing how an anchor can be used to secure the chain holding member.

The construction of the anchor members 28 and 29 will be apparent from an examination of FIGS. 5 to 8. Each anchor preferably comprises an elongate plate 52 having threaded holes 54 provided therein for reception of the fasteners 22 or 24. Preferably an anchor is provided for each of the holding member 16 and the receiver 20 in order that each will be securely held on the door or door jamb. The anchor for the holding member 16 is shown in FIG. 8. As shown in dashed lines in FIG. 6, each plate 52 is curved about a longitudinally extending axis of the plate and in the preferred illustrated embodiment forms a semi-cylinder. In this way the plate 52 will fit easily into a circular hole 57 drilled in the door or door jamb. Attached to the end of the plate 52 is an end plate 56, 55 with screw holes provided therein. This end plate is adapted to secure the anchor by means of screws 58 to the edge of the door or door jamb as shown in FIG. 6. The end plate also provides means for positioning the anchor correctly in the opening since it rests against the side edge of the door or door jamb as shown. In order to provide the necessary threaded holes 54, steel nuts 60 can be welded to the plate 52 on the concave side thereof.

It will thus be seen that the present invention has provided a very secure means for mounting a lock or a portion thereof to a door or door jamb. With the inner ends of the threaded fasteners secured by the anchor located on the inside of the door or door jamb, it would be necessary for a thief or burglar to destroy the door or door jamb in order to force open the lock of this invention. It will be appreciated that the described anchor plate is particulary suited for installation in a wooden or metal-encased wooden door and in a wooden door jamb into which the required holes can be drilled. If the door is made of metal with a hollow core, then an expansion-type anchor can be employed to hold the member 16 and the receiver 20. These anchors, which are well known for other purposes have only a small diameter or width to permit insertion of the anchor through a small drilled hole in the side of the door or door jamb. After the anchor has passed through the small hole and into the much larger hollow space in the door or door jamb, it either expands automatically to a much greater width such as by means of a spring mechanism provided or it can be expanded by turning the bolt on which the anchor is mounted. As far as the applicants are aware, such expansion type anchors have never been used with locks and particularly chain-type locks although they have been used to secure heavy items to wall surfaces, for example shelves to a wall made from wall board.

It will be appreciated by those skilled in the art of locks that various modifications and changes could be made to the specific form of lock that has been described herein. It will be clearly understood that all such modifications and changes as fall within the scope of the appended claims are intended to be encompassed by this invention.

What I claim as my invention is:

1. A chain-type lock comprising:

a locking chain having a locking bar connected to one end thereof;

a chain holding member having the other end of said locking chain fastened thereto, first fastener means for mounting said holding member to a door, door jamb or the like, said first fastener means being adapted for insertion through holes formed in said holding member, a receiver for securing said locking bar in a locked position, said receiver having means for holding said locking bar, second fastener means for mounting said receiver to a door, door jamb or the like, said second fastener means being adapted for insertion through holes formed in said receiver, and at least one anchor engageable with said first or said second fastener means in order to hold securely the first or second fastener means in the door, door jamb or the like, said first or second fastener means being receivable in threaded holes formed in said at least one anchor which is adapted for insertion into an opening formed in the door, door jamb or the like, said at least one anchor having an end plate rigidly attached thereto at one end, said end plate providing means for positioning the anchor correctly in said opening.

2. A chain-type lock according to claim 1 wherein there are two anchors provided, one for each of said first and second fastener means.

3. A chain-type lock according to claim 1 wherein said at least one anchor comprises an elongate plate having said threaded holes provided therein for reception of the fastener means.

4. A chain-type lock according to claim 1 wherein said chain holding member has an opening therein into which said one end of said chain extends and a hardened metal pin is mounted in said holding member and extends across said opening and through said one end of said chain.

5. A chain-type lock according to claim 3 wherein said locking bar has a knob connected thereto by a shaft extending perpendicularly from the side of one end of said locking bar.

6. A chain-type lock according to claim 5 wherein said said holding means is an opening in the front of said receiver just large enough to permit passage of said locking bar therethrough and a space in the back of said receiver large enough to permit said locking bar to pivot about the centre of said shaft after the bar itself has passed through said opening, said pivoting motion causing said bar to be locked in said receiver.

7. A chain-type lock according to claim 6 wherein said space in said receiver is enclosed by said receiver on all sides except across the rear side.

8. A chain-type lock according to claim 2 wherein each anchor comprises an elongate plate having said threaded holes provided therein for reception of the fastener means.

9. A chain-type lock according to claim 8 wherein each anchor plate is curved about a longitudinally extending axis of the plate and a nut is fixed to the plate at each hole therein for threadedly receiving the fastener means.

10. A chain-type lock according to claim 9 wherein each nut is rigidly secured to the concave side of the anchor plate which is semi-circular in cross-section.

11. A chain-type lock comprising:

a locking chain having a latch bar connected to one end thereof, a chain holder having the other end of said locking chain connected thereto and having holes therein for receiving threaded fasteners, a latch bar bracket for securing said latch bar in a locked position and having holes therein for receiving threaded fasteners, said bracket having means for holding said latch bar, and at least one anchor plate member having threaded holes therein for receiving the threaded ends of at least some of said threaded fasteners in order to hold securely said some fasteners in a door, door jamb or the like, said anchor plate member being adapted for insertion into an opening in a door, door jamb or the like, said at least one anchor plate member having an end plate rigidly attached thereto at one end, said end plate providing means for positioning the anchor correctly in said opening.

12. A chain-type lock according to claim 11 wherein said anchor plate member is elongate and curved in a plane perpendicular to a longitudinal centreline of the plate member.

13. A chain-type lock according to claim 12 including two anchor plate members, one for each of said chain holder and said latch bar bracket, each having holes therein for receiving the threaded ends of at least two threaded fasteners.

14. A chain-type lock according to claim 13 including said threaded fasteners which can secure said chain holder to a door, door jamb or the like by extending through said holes in the holder and engaging one of the said anchor plate members and which can secure said latch bar bracket to a door, door jamb or the like by extending through said holes in said bracket and engaging the other of said anchor plate members.

15. A chain-type lock according to claim 13 wherein said chain holder has a hardened metal pin mounted therein and extending through said other end of said chain.

16. A chain-type lock according to claim 15 wherein said chain holder has an opening in the front thereof into which said other end of said chain extends and said pin is positioned in the interior of said holder and is protected thereby.

17. A chain-type lock according to claim 13 wherein said latch bar comprises an elongate bar member, a shaft extending from one side of one end of said bar member, and a knob mounted on said shaft and said holding means is a hole in said bracket just large enough to permit passage of said bar member therethrough.

18. In a locking device for a door, door jamb or the like, an anchor for securely fastening at least a portion of said device to the door, door jamb or the like, said anchor comprising a curved metal plate insertable into a hole formed in the edge or side of the door, door jamb or the like and having threaded openings in said plate, said openings being adapted to receive threaded fasteners extending through and from at least said portion of said device, said anchor having an end plate with holes for additional fasteners provided therein, said end plate being rigidly fixed to one end of said curved metal plate and being adapted to secure the anchor to the edge or side of the door, door jamb or the like.

19. A chain-type lock comprising:

a locking chain having a latch bar connected to one end thereof;

a chain holder having the other end of said locking chain connected thereto and having holes therein for receiving threaded fasteners, a latch bar bracket for securing said latch bar in a locked position and having holes therein for receiving threaded fasteners, said bracket having means for holding said latch bar, and two elongate anchor plate members, one for each of said chain holder and said latch bar bracket and each member having threaded holes therein for receiving the threaded ends of some of said threaded fasteners in order to hold securely said some fasteners in a door, door jamb or the like, each anchor plate member being adapted for insertion into an opening in a door, door jamb or the like, having a semi-circular cross-section, and having an end plate with screw holes therein rigidly attached at one end, wherein each end plate is provided to secure the anchor plate member to the edge or side of the door, door jamb or the like.

* * * * *